US005238200A

United States Patent [19]

Ritzenthaler

[11] Patent Number: 5,238,200

[45] Date of Patent: Aug. 24, 1993

[54] POWER DRIVEN WINDING DEVICE WITH SPOOL AXIALLY MOVABLE TO ENGAGE A CLUTCH

[76] Inventor: Robert Ritzenthaler, 1181 Kempton Park, McKinney, Tex. 75069

[21] Appl. No.: 731,980

[22] Filed: Jul. 18, 1991

[51] Int. Cl.[5] ..... B65H 16/00; B65H 75/40; B63B 2/16; B66D 1/00

[52] U.S. Cl. ..... 242/86.5 A; 114/254; 242/86.7; 254/330; 254/375

[58] Field of Search ..... 242/86.5 A, 86.5, 86.7; 114/254; 441/136; 254/329, 330, 362, 375, 365, 366

[56] References Cited

U.S. PATENT DOCUMENTS

| | | | |
|---|---|---|---|
| 1,212,009 | 1/1917 | Borland et al. | 254/330 |
| 1,317,322 | 6/1918 | Schipper | 254/330 X |
| 1,750,815 | 3/1930 | Rix | 254/325 |
| 1,936,713 | 11/1933 | Freeman et al. | 254/366 X |
| 2,727,724 | 12/1955 | Biebighauser | 254/330 |
| 3,034,742 | 5/1962 | Reynolds | 114/254 |
| 3,041,996 | 7/1962 | Roberts | 242/86.5 A |
| 3,043,259 | 7/1962 | Sadler | 242/86.5 A X |
| 3,081,732 | 3/1963 | Breland | 242/86.5 A |
| 3,098,463 | 7/1963 | Brown | 114/254 |
| 3,156,429 | 11/1964 | Jones, Jr. | 242/86.5 A |
| 3,162,395 | 12/1964 | Bray | 242/86.5 A |
| 3,178,127 | 4/1965 | Andersen | 242/86.5 A |
| 3,215,361 | 11/1965 | Jones, Jr. | 114/254 |
| 3,232,555 | 2/1966 | Gorrell et al. | 242/86.5 A |
| 3,315,914 | 4/1967 | Turner | 242/86.5 A |
| 3,494,570 | 2/1970 | Jones, Jr. | 242/86.5 A |
| 3,813,055 | 5/1974 | Pickrell | 242/86.5 A |
| 3,886,888 | 6/1975 | Parsons | 114/254 |
| 3,948,488 | 4/1976 | Brockelsby | 254/323 |
| 3,964,425 | 6/1976 | Septor, Sr. | 242/86.5 R |
| 4,084,793 | 4/1978 | Gardiner | 254/346 |
| 4,098,213 | 7/1978 | McGinnis | 114/254 |
| 4,133,496 | 1/1979 | Zetah | 242/86.5 A |
| 4,378,750 | 4/1983 | Holzhauer | 114/249 |
| 4,455,961 | 6/1984 | Hansen et al. | 114/254 |
| 4,624,141 | 6/1986 | Soleau | 73/865.8 |
| 4,721,833 | 1/1988 | Dubay | 242/54 R X |
| 4,960,065 | 10/1990 | Junkeris | 114/254 |

*Primary Examiner*—Daniel P. Stodola
*Assistant Examiner*—John Rollins
*Attorney, Agent, or Firm*—Jones, Day, Reavis & Pogue

[57] ABSTRACT

A rope winding device having a spool rotatably coupled to the device for receiving the rope, a drive motor attached to the device for rotating the spool to wind the rope on the spool and a solenoid coupled between the device and the spool for selectively moving the spool axially into and out of engagement with the drive motor for selectively rotating the spool. A switch is provided in the rope eyelet for automatically causing the motor to stop when the line is reeled in to its maximum extent. The device includes a stop member on the ski rope for preventing the weight of the towed load to be placed on the spool and includes a friction member for braking the spool and preventing free rotation thereof.

14 Claims, 7 Drawing Sheets

POWER DRIVEN WINDING DEVICE WITH SPOOL AXIALLY MOVABLE TO ENGAGE A CLUTCH

FIELD OF THE INVENTION

The present invention relates to rope winding devices in general and, in particular, to a rope winding device intended for retrieval of a rope used during water skiing.

BACKGROUND OF THE INVENTION

There are a number of devices in the prior art intended for retrieval of a rope used during water skiing. In some devices, there is no way to automatically stop the motor when the rope is in or fully retrieved. In some of the prior art devices, friction clutches protect the motor and the motor can keep turning, even though the rope is not being wound on the spool. In others, switches exist which automatically stop the motor when the rope is fully in but no provision is made for operator control other than separately starting and stopping the motor with a second individual switch when there is no automatic control of the motor.

Further, there is no automatic brake for the motor when it is not energized. The prior art does disclose a manually positionable brake lever that can be used to lock rotation of the drum when the device is not in use.

Also, there is no way to allow the motor to rotate substantially freely when the rope is being pulled out while not fouling the rope. Some devices in the prior art have a frictional drag of the gears which rotate the speed at which the rope is pulled out. Others require the loosening of a nut and still others allow a total freewheeling of the spool which can, of course, foul the rope. Also, in some of the prior art devices, there is no way to remotely couple the motor to the spool. The prior art discloses remote energization of the motor but not remotely coupling the motor to the spool. Finally, in some cases in the prior art, the reel-in device is portable and has to be moved when it is not in use.

The present invention is preferably made of plastic insofar as the spool or reel is concerned and is, therefore, lightweight and easy to install The device has a means for automatically stopping the motor when the rope is wound in and, at the same time, enables the operator of the boat to further disable the motor so that in the event the rope is partially pulled off of the reel, the motor will not start again. Also, the present invention has an automatic brake for the motor when it is not energized.

The present invention also allows the reel to rotate while the rope is being pulled out and yet sufficient tension is applied to the reel so that the rope is not fouled.

Also, in the prior art, there is no way to remotely couple the motor to the spool. In the present device, the motor can be coupled to the spool and disengaged from the spool remotely Thus, it is an object of the present invention to provide a rope winding device that is small and lightweight and easy to install on a mechanism or device such as a boat.

It is also an object of the present invention to automatically stop the motor when the rope is completely wound in and yet allow the operator the ability to remotely turn off the motor so that it cannot come back on in the event the rope slips away from its wound-in position.

It is yet another object of the present invention to provide an automatic brake for the motor when it is not energized, thus preventing the spool from inadvertently unwinding the rope.

It is still another object of the present invention to allow the spool to unwind the rope under the pressure of a friction engagement with the motor thus allowing the rope to be pulled out under sufficient pressure to prevent the spool from freely spinning and fouling the rope It is also an object of the present invention to provide means for remotely coupling the motor to the spool to rewind the rope when desired

SUMMARY OF THE INVENTION

Thus the present invention relates to a rope winding device comprising a spool for receiving the rope rotatably coupled to a frame, drive means attached to the frame for rotating the spool to wind the rope on the spool, and means coupled between the frame and the spool for selectively engaging and disengaging the spool with the drive means for selectively rotating the spool The invention also relates to a rope winding device comprising a base for attachment to a structure, a motor attached to the base, the motor having a drive shaft extending in a direction away from the base, a hollow spool open at one end and having a plate closing the other end, the spool surrounding the motor and being rotatably coupled to the base, the drive shaft extending through an orifice in the end closing plate of the spool, and clutch means attached to the outer end of the drive shaft and having a first position with respect to the spool in which the drive shaft is coupled to the spool for rotation thereof and a second position in which rotation of the spool is resisted.

BRIEF DESCRIPTION OF THE DRAWINGS

These and other objects of the present invention will be more fully disclosed in conjunction with the accompanying drawings in which like numerals represent like elements and in which.

DETAILED DESCRIPTION OF THE DRAWINGS

Figure 1:
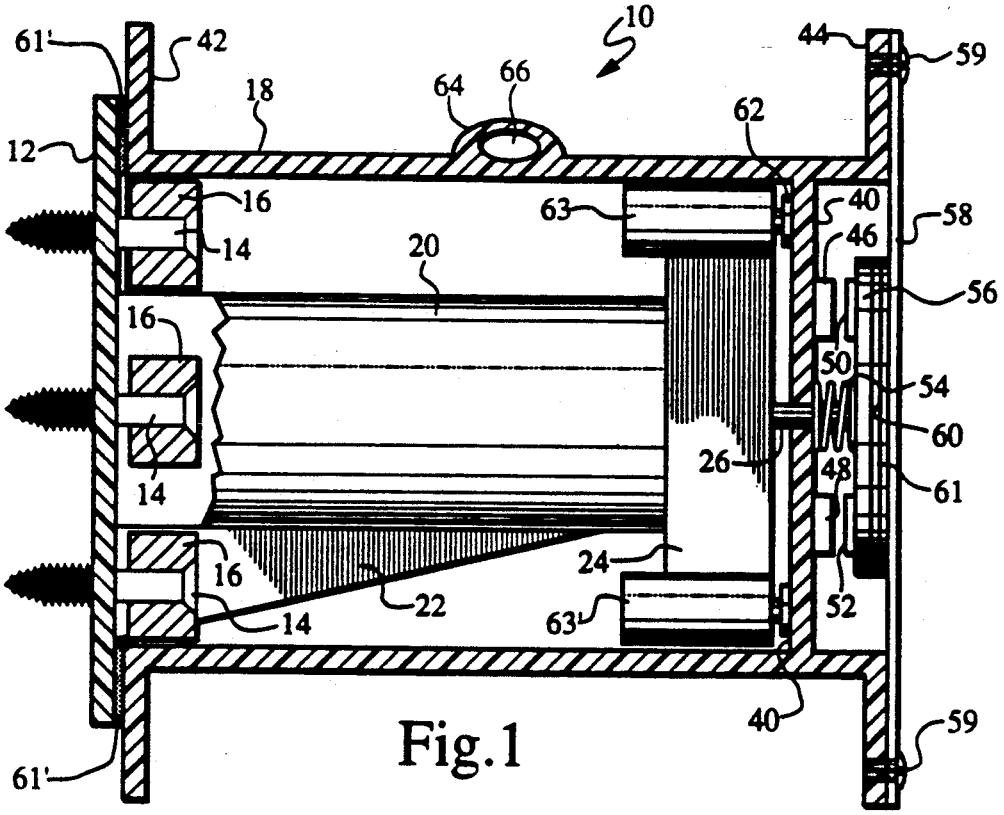
FIG. 1 is a partial cross-sectional side view of the novel rope winding device in a position to resist rotation of the rope-containing spool.
Figure 16:
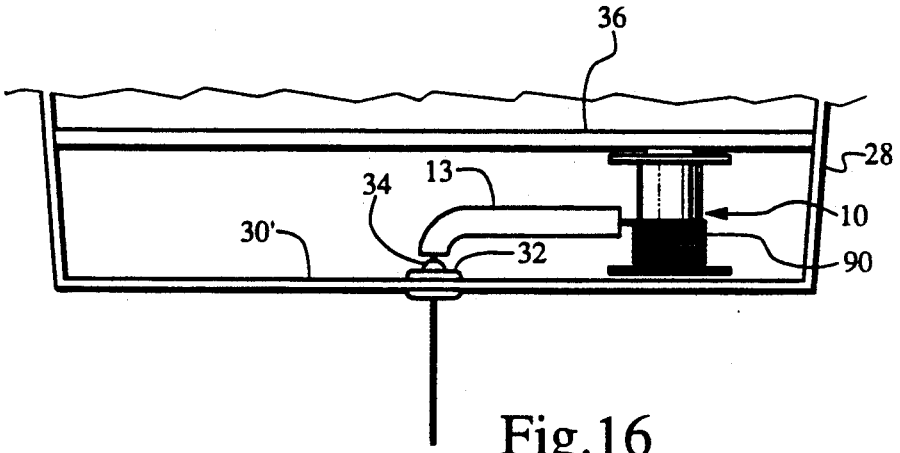
FIG. 16 is a top view of the rear portion of the boat illustrating the novel device inserted in the rear of the boat with the ski rope being coupled through the eyelet on the transom of the boat.
Figure 20:
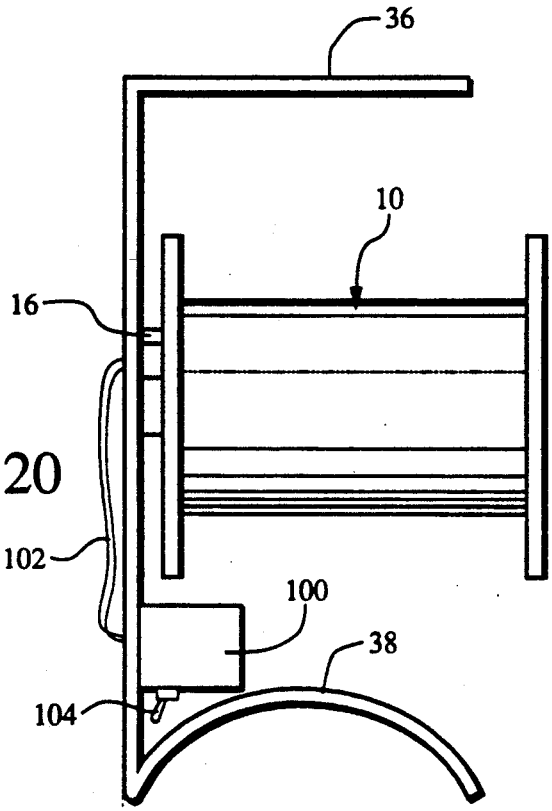
FIG. 20 is an alternate version of the device illustrating a hand-held frame with the novel invention thereon for winding a kite string.

The novel device 10 illustrated in FIG. 1 comprises a base portion 12 and a spool 18 on which the rope is to be wound. The base 12 may be attached to any structure 36 such as the boat transom as illustrated in FIG. 16 or to a hand-held structure as illustrated in FIG. 20. Bolts 14 may attach the base 12 to the structure 36 and bearings 16 may be held in place by the bolts 14. In the alternative, bearings 16 may be projections integrally formed with the base 12 simply to provide a surface on which the spool 18 may ride. A motor 20 is attached by any well-known means to the base 12. It is supported by a portion 22 which relieves the pressure on the motor mounts because of the weight extending therefrom. A gear box 24 is mounted on the end of motor 20 for purposes of reducing the speed of the drive shaft 26. It generates an output on drive shaft 26. Spool 18 has a first plate 40 attached to or integrally formed with the outer end of the spool 1B. Spool 1S also has flanges 42 and 44 on the ends thereof to contain the rope. First plate 40 has protrusions 46 and 48 thereon which are opposite protrusions 50 and 52 on clutch member 56. Clutch member 56 is attached fixedly to drive shaft 26. A spring means 54 around shaft 26 between the first plate 40 and clutch member 56 biases the spool 18 to the left in FIG. 1, thus separating the protrusions 46–50 and 48–52.

Figure 2:
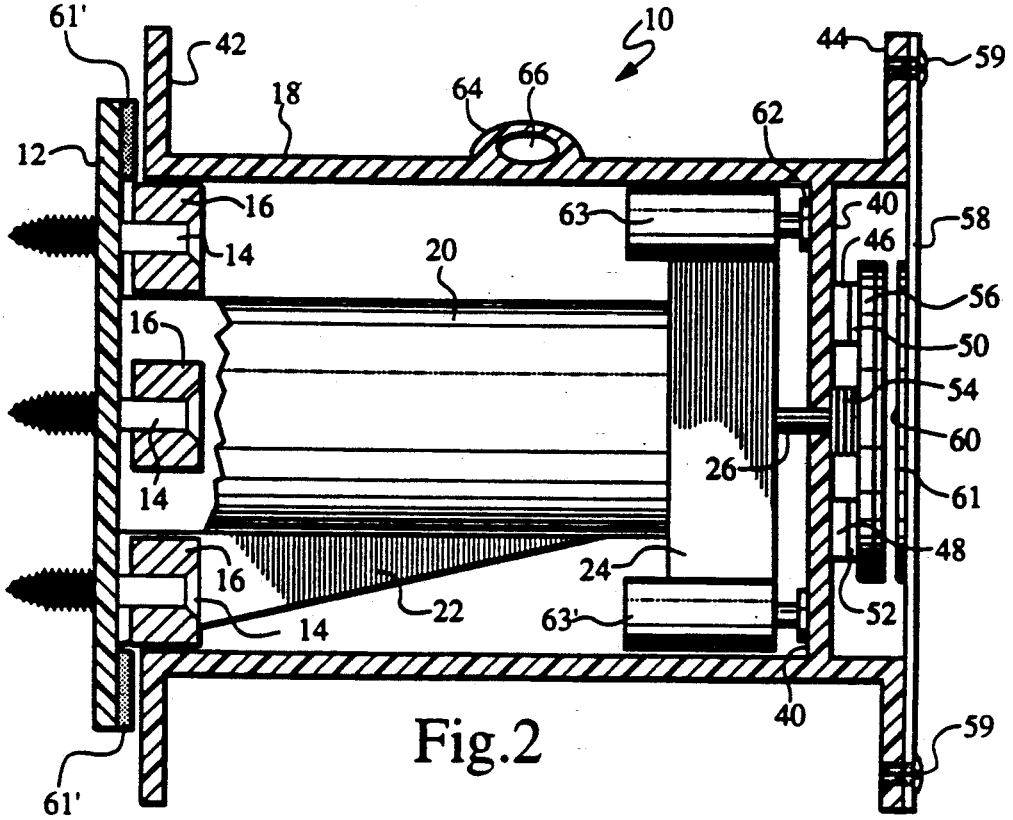
FIG. 2 is a partial cross-sectional side view of the novel rope winding device of the present invention illustrating the device in the position in which the motor is engaged with the spool for rotating the spool.

A second plate 58 is attached to the outer side of flange 44 by means of bolts or screws 59 as shown. Attached to second plate 58 is a friction device 60. This friction device can be a rubber plate or other friction material. In like manner, the side of clutch 56 facing friction plate 60 also has a friction plate 61 on it which can also be rubber or other type friction device. In the position shown in FIG. 1, spring 54 has forced the spool 18 to the left with respect to clutch 56, thus separating the protrusions 46–50 and 48–52. However, it has pulled the friction plate 60 into contact with the friction plate 61 on clutch 56, thus causing a resistance to any rotational movement of spool 18. In the alternative, a rubber or other type friction device 61′ could be attached to the spool side of base member 12 adjacent flange 42 as shown in FIG. 1 and FIG. 2. In FIG. 1, the spool is in its nonrotating position and flange 42 is in contact with friction device 61′, thus resisting rotation of spool 18. In FIG. 2, spool 18 is moved to the right in its rotatable position. Flange 42 is disengaged from friction device 61′, thus allowing spool 18 to be freely rotated by the motor 20. Either friction device 61 or 61′ could be used or, if desired, both could be used simultaneously. The use of friction device 61′ allows greater variation in adjustment of friction since more or less friction material 61′ can be placed circumferentially adjacent flange 42 as needed.

As shown in FIG. 2, a solenoid 63 has been energized, causing the solenoid plunger 62 to move outwardly to the right in FIG. 2, thus forcing spool 18 to the right in FIG. 2 thereby separating the friction plate 60 and the friction plate 61 on clutch 56 or friction device 61′ is separated from flange 42. However, protrusions 46 and 50 are now engaged in any well-known manner and protrusions 48 and 52 are also likewise engaged The spring 54 is compressed In this position, if motor 20 is energized, the engaged protrusions 46–50 and 48–52 rotate the spool 18 with respect to the motor 20 Note that the inner open end of the spool 18 rests on and is carried by bearings or one-piece plastic plugs 16. The outer end of the spool 18 is carried by the shaft 26 of motor 20 which extends through an orifice in first plate 40. Thus, in FIG. 2, when the motor 20 is energized, rotation of shaft 26 also rotates clutch plate 56 which has protrusions 50 and 52 thereon that engage protrusions 46 and 48 respectively on the first plate 40 forming part of spool 18. Thus, spool 18 rotates and is driven by motor 20. When the motor is de-energized and solenoid 63 disengaged, the spring 54 forces spool 18 to the left, thus separating the protrusions 46–50 and 48-52 but engaging friction plates 60 and the friction plate 61 on clutch 56. Thus, as can be seen in FIGS. 1 and 2, the spool 18 can be readily engaged and disengaged from motor 20 from a remote location, such as the cockpit of a boat, by engaging a switch (not shown) to operate solenoid 63. Further, in the disengaged position of the solenoid 63, the friction plates 60 and 61 tend to prevent rotation of spool 18 with respect to motor 20, thus preventing the spool 18 from freewheeling and allowing the line to play out. Also, the spool 18 is always supported by the bearings 16 in either position shown in FIG. 1 and FIG. 2. A second solenoid 63′ on the diametrically opposed side of spool 18 from solenoid 63 may be used if necessary to provide balanced forces to plate 40 of spool 18.

Figure 3:
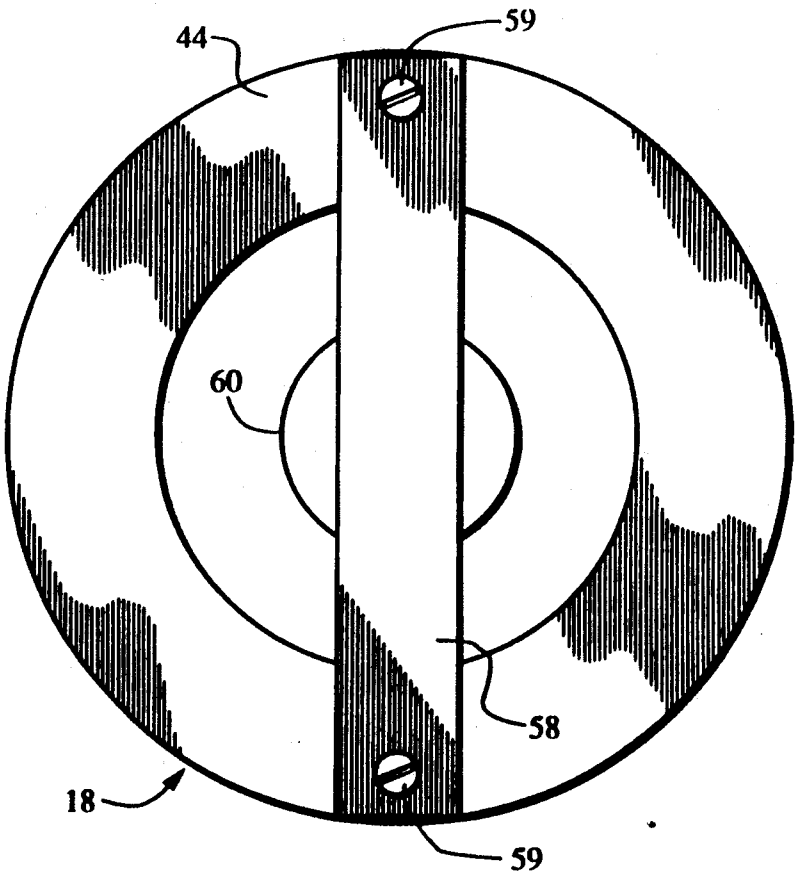
FIG. 3 is an end view of the novel device illustrating the brake disc mounted to the outer end of the spool.

FIG. 3 is an end view of the device 10 illustrating flange 44 and plate 58 on which friction pad or disc 60 is mounted to act as a brake. In FIG. 3, the brake disc is on the reverse side of the area 60 shown.

Figure 4:
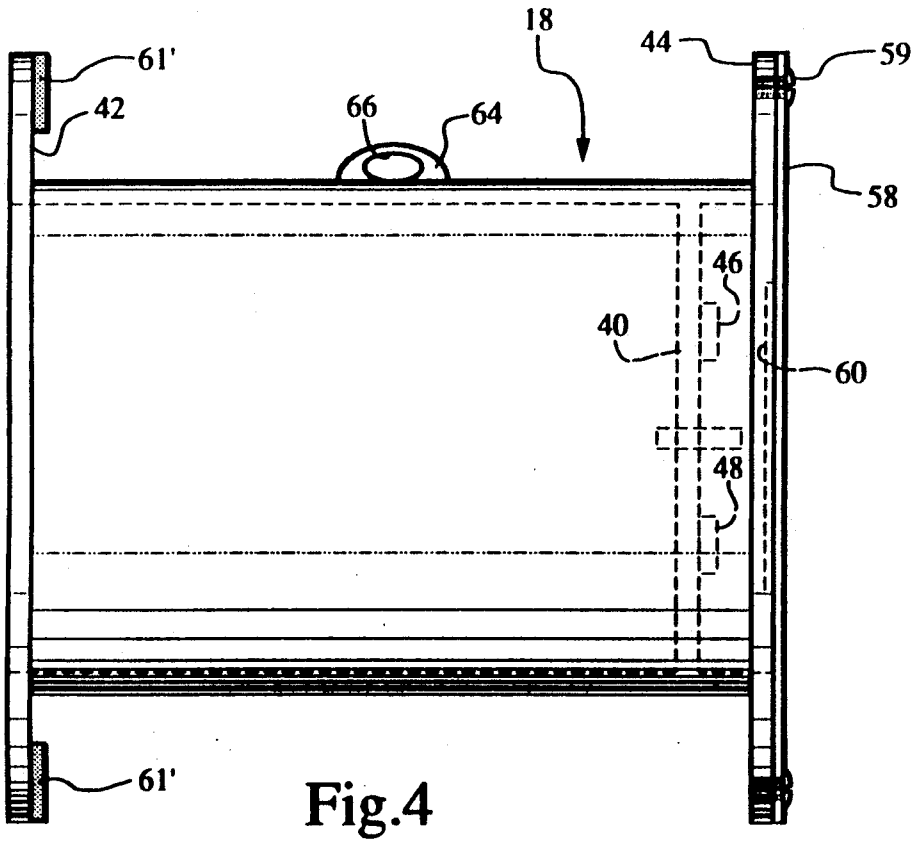
FIG. 4 is a side view of the spool alone illustrating in dashed lines the end closure plate having protrusions thereon for being driven by the motor and the outer plate having the brake disc mounted thereon.

FIG. 4 is a side view of the novel drum or spool 18. The two flanges 42 and 44, one on each end, can be clearly seen. The first plate 40 is illustrated in phantom lines with the protrusions 46 and 48 thereon. In addition, second plate 58 is shown attached to flange 44 by means such as screws or bolts 59 and the brake pad 60 is illustrated in phantom lines. A tow rope can be attached in orifice 66 in mount 64. Also, the alternative friction mounts 61' can be seen.

Figure 5:
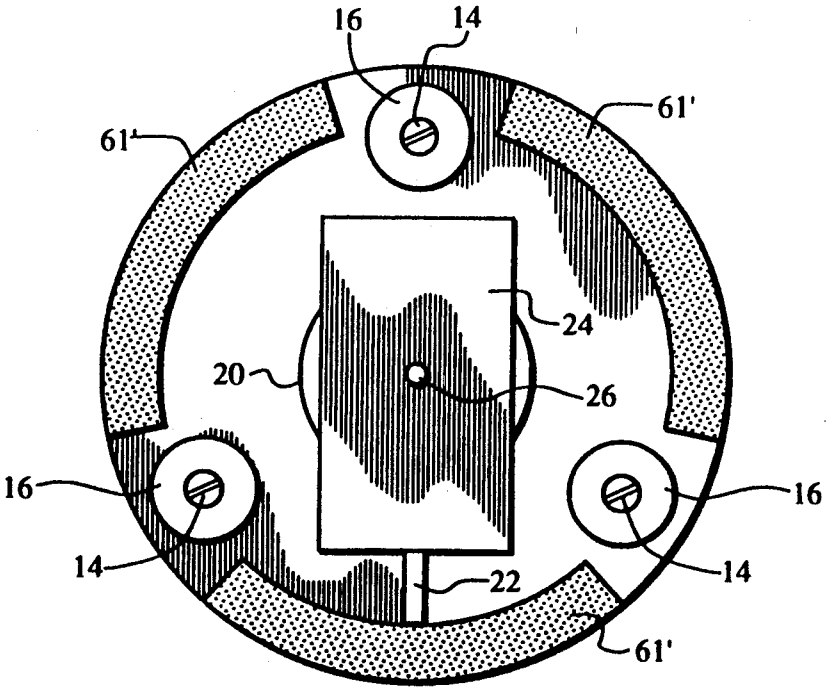
FIG. 5 is an end view of the base plate with the motor mounted thereon.

FIG. 5 is an end view of the base plate 12 with the bearings 16 mounted thereon with the use of bolts or screws 14. The motor 20 with gear box 24 and shaft 26 all supported by the brace 22 and all attached in any well-known manner to the base 12. The friction material 61' shown in FIG. 5 may be cut to any desired arcuate length to adjust the amount of friction desired.

Figure 6:
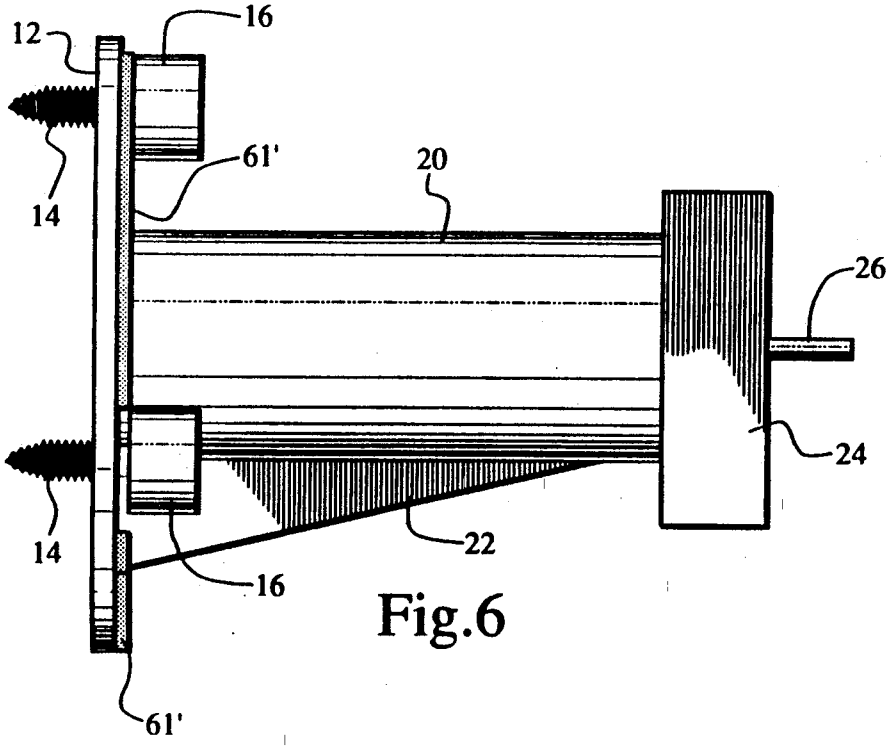
FIG. 6 is a side view of the motor mounted to the base in FIG. 5.

FIG. 6 is a side view of the device shown in FIG. 5 wherein the mount plate or base 12 can be clearly seen with the bearings 16 held in place by bolts 14. The motor 20, gear box 24, shaft 26 and brace 22 are also clearly shown.

Figure 7:
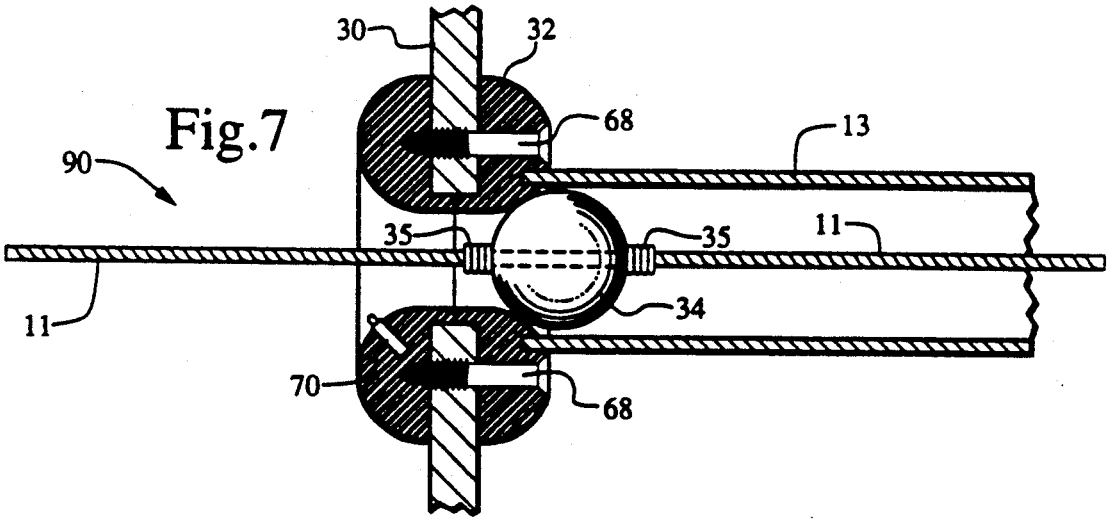
FIG. 7 is a partial cross-sectional view of an eyelet mounted to a boat transom and illustrating the manner in which the weight of the skier is supplied to the eyelet through a stop element.

FIG. 7 is a partial cross-sectional view of the boat transom 30 illustrating the eyelet 32 mounted thereon with screws 68 and illustrating a tube 13 for guiding the rope to the spool 18. The eyelet 32 is shown in halves that may be mounted together in any well-known manner such as by screws 68. As can be seen in FIG. 7, the stop member 34 is larger than the orifice in the eyelet 32, thus enabling all of the weight of the skier to be applied through stop member or device 34 and eyelet 32 to the transom 30. Stop device 34 can be held in fixed position on rope 11 by any well-known means such as knots or projections 35 on rope 11. It will be noted that eyelet 32 has an electrical switch 70 which will be used as discussed hereafter.

Figure 8:
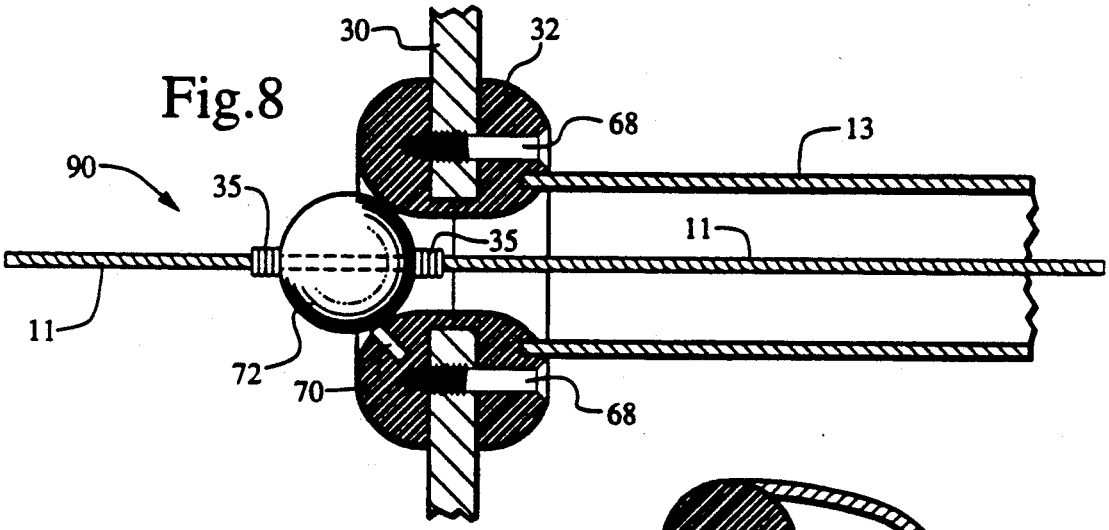
FIG. 8 is a partial cross-sectional view of the eyelet in the boat transom illustrating a stop device contacting an electrical switch in the eyelet which shuts off the motor as the rope is being wound in on the spool.

FIG. 8 discloses the eyelet 32 when the rope 11 is wound in. A second stop device 72, which again is fixedly attached to the rope 11 in any well-known manner, contacts the electrical switch 70 and opens the switch 70. As will be seen hereafter, switch 70 is in electrical series with the motor 20, thus stopping motor 20 when stop device 72 opens switch 70 indicating that all the rope is wound on spool 18.

Figure 9:
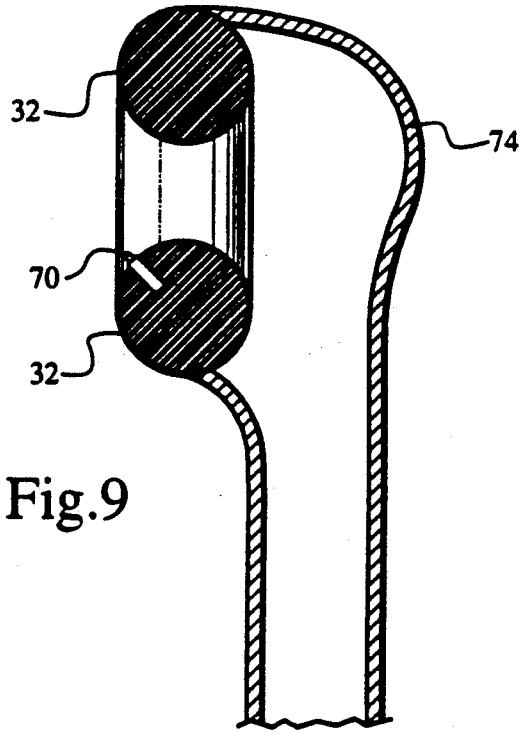
FIG. 9 illustrates the eyelet mounted on a ski pylon for inboard motor boats.
Figure 10:
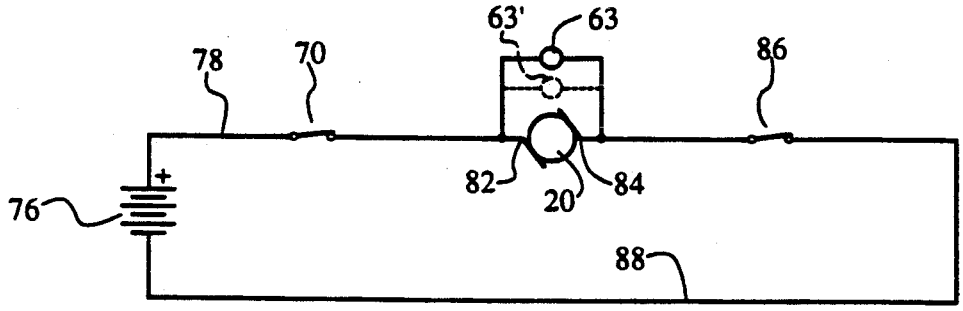
FIG. 10 is a schematic diagram illustrating the electrical connections between the eyelet switch, the motor and the dashboard switch with the switches in position for winding in the rope.

FIG. 9 illustrates how the eyelet 32 fits on the entrance to a ski pylon 74 that is found on most inboard engine boats. Again, the eyelet 32 has a switch 70 which can be used to stop motor 20 and cause a cessation of the rope winding. The rope is guided through the hollow pylon 74 to the spool 18 coupled to the motor 20.

FIGS. 10, 11, 12 and 13 illustrate the circuitry to operate the motor 20. From battery 76, connection 78 is made to eyelet switch 70. When the rope is played out, switch 70 is closed and the power is coupled in parallel to terminals 82 and 84 of motor 20 and to solenoid 63 and alternative solenoid 63'. From there, the circuit is completed through a dashboard switch 86 and through a return wire 88 to the battery With the circuit as in FIG. 10, the rope is winding in because eyelet switch 70 is closed, the dashboard switch 86 is closed and current flows through motor 20 and solenoid 63 (and alternative solenoid 63'), thus causing the spool 18 to shift from its first position where it is disengaged from the motor to its second position where it is engaged with the motor. Since motor 20 is also energized, the spool 18 begins to rotate and wind in the rope.

Figure 11:
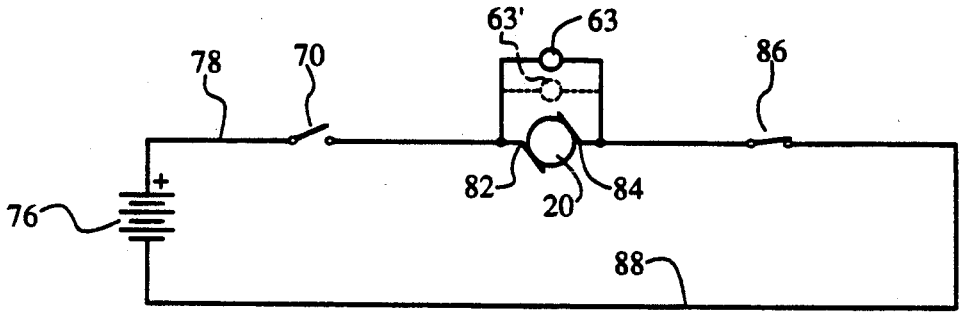
FIG. 11 is a schematic of an electrical diagram illustrating the connection when the motor is stopped because the stop member on the rope has opened the eyelet switch.

In FIG. 11, once the rope has been wound completely in, the eyelet switch 70 opens thus breaking the circuit to the motor 20 and the solenoid 63. Motor 20 is de-energized, the solenoid 63 (and alternative solenoid 63') is de-energized and the spring 54 returns the spool 18 to the left in FIG. 1, disengaging it from being driven by the motor and engaging the brake discs 60 and 61 to prevent the spool 18 from freely rotating.

Figure 12:
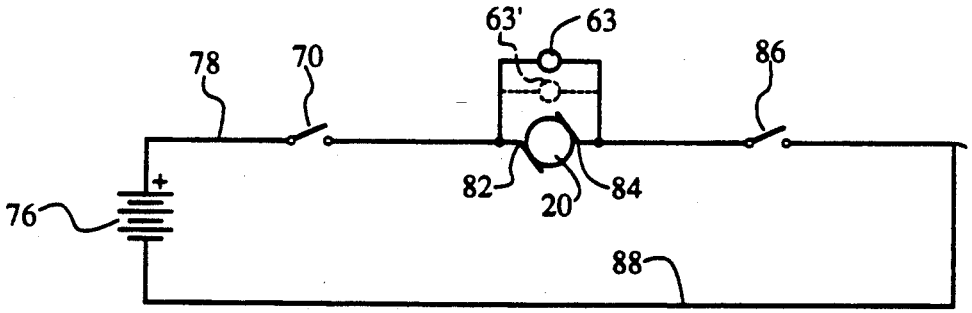
FIG. 12 is a schematic electrical diagram illustrating both the eyelet switch open and the dashboard switch open which is the normal state of the circuit with the rope wound on the spool.

FIG. 12 illustrates the normal state with the rope wound in, in which the eyelet switch 70 is open and the dashboard switch 86 is open. In that state, of course, the motor is not energized and the spool 18 resists rotation because of the friction brakes 60 and 61.

Figure 13:
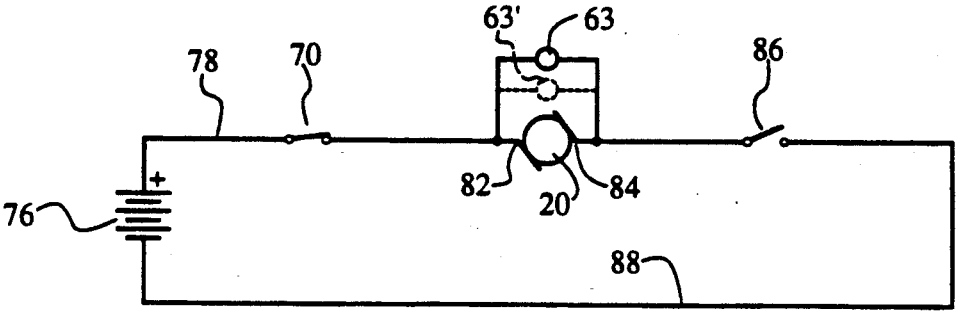
FIG. 13 is an electrical schematic diagram illustrating the eyelet switch closed and the dashboard switch open during which the rope is being pulled out by hand, preparatory for water skiing.

In FIG. 13, the rope is being let out. The eyelet switch 70 closes but the dashboard switch 86 is still open, thus the motor and the solenoid remain de-energized. The rope can be pulled out against the friction of the pads 60 and 61.

Figure 14:
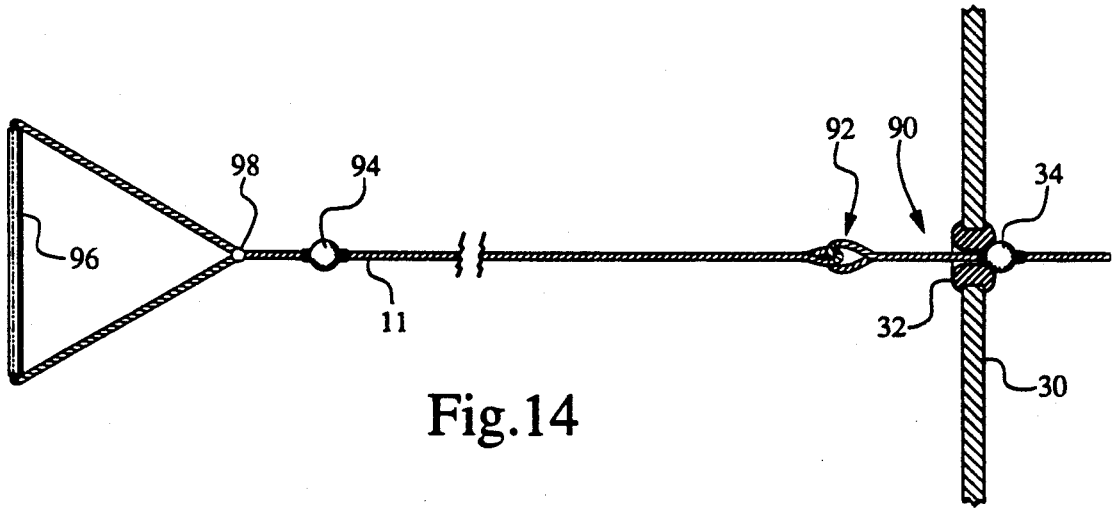
FIG. 14 illustrates the rope in its fully played out position with the lead rope stop member against the transom eyelet to receive the weight of the skier and the handle stop member which engages the eyelet switch to turn off the motor when the rope is being wound inwardly on the spool.
Figure 15:
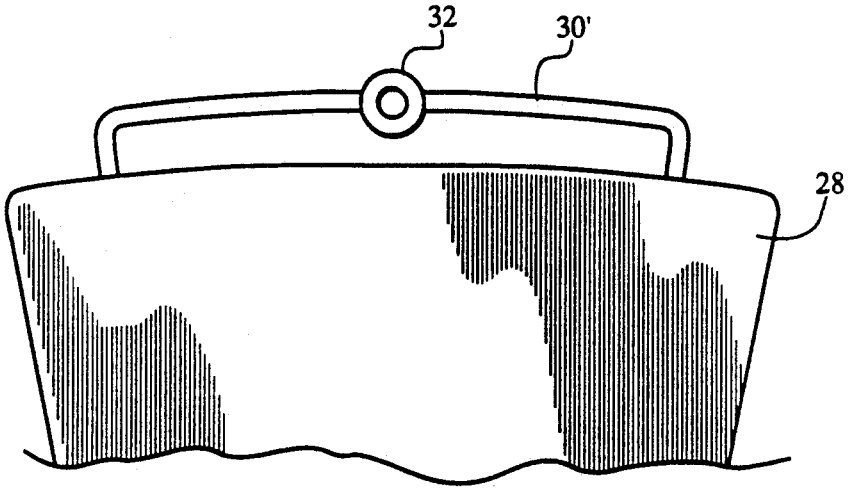
FIG. 15 is a diagrammatic representation of the rear view of a boat illustrating a tow bar with the eyelet through which the ski rope would pass.

FIG. 14 is a plan view of the rope 11 extending through stop member 34, the eyelet 32 in transom 30, connection 92, stop member 94, junction 98 and handle 96. The lead rope 90 couples to the tow rope 11 at 92 in any well-known fashion. The lead rope 90 is approximately four feet in length FIG. 15 is a schematic representation of the stern of a boat 28 illustrating a tow bar 30' with the eyelet 32 therein FIG. 16 is a top view of the rear portion of a boat illustrating the eyelet 32 in the transom 30. Rope winding device 10 is attached to wall 36 of the boat. The lead rope 90 passes through guide tube 13 to eyelet 32 in the transom 30 of the boat The stop member 34 prevents the lead rope 90 from further unwinding from the rope winding device 10.

Figure 17:
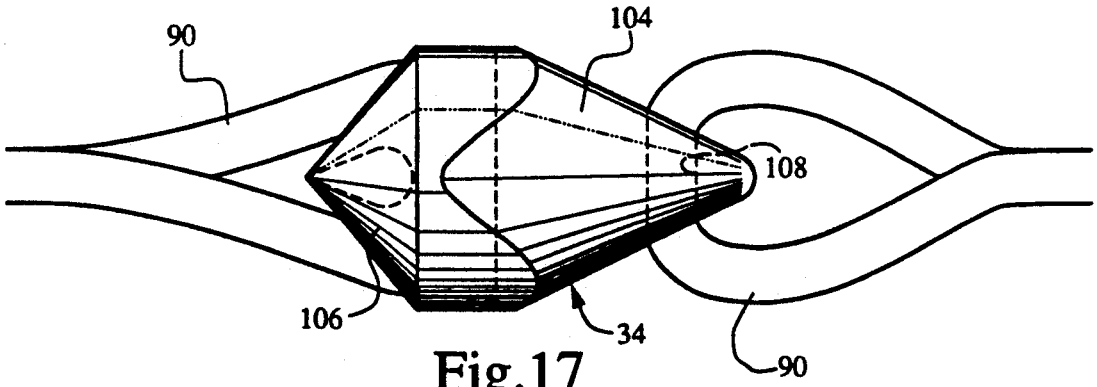
FIG. 17 is the top view of the stop member that can be used for either the lead rope stop member or the handle stop member.
Figure 18:
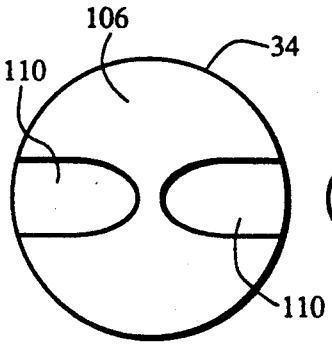
FIG. 18 is a front view of the stop member in FIG. 17.
Figure 19:
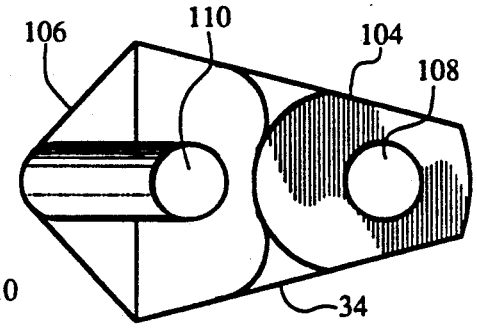
FIG. 19 is a side view of the stop member illustrated in FIG. 17.

FIGS. 17, 18 and 19 are top, front and side views of one type of stop member 34 other than a spherical device. The lead rope 90 is attached through an orifice 108 in one end 104 of the device 34. The end 104 is basically conical in shape. The other end 106 is also basically conical in shape and has the other portion of the lead rope 90 inserted through an orifice 110. That portion of end 104 which has orifice 108 form a flat spot in that area. Otherwise the remainder of the end 104 is conical in shape. This particular shape allows the stop member 34 to guide itself into the eyelet 32 as well as allowing it to move in the opposite direction through the tube 13 to the spool 18 without being entangled or caught. FIG. 17 is a top view of the stop member 34, FIG. 18 is a front view and FIG. 19 is a side view.

FIG. 20 is a schematic representation of another use of the inventive device herein The rope or line winding device 10 as illustrated in FIG. 20 can be coupled to a frame structure 36 for the purpose of winding in kite string The structure 36 has a curved lower portion 38 which can be placed on the leg while the upper portion is held by one hand. The rope winding device 10 is attached to the structure 36 as indicated previously by bolts which hold bearing 16. A battery 100 provides power through leads 102 to the motor 20 inside of the rope winding device 10. By operating a switch 104, battery power can be coupled to the motor 20, thus winding in the kite string.

Thus, the novel rope winding device includes a spool rotatably coupled to a base member with the spool receiving the rope. The motor has a drive shaft extending in a direction away from the base. A hollow spool open at one end and having a plate closing the other end surrounds the motor and is coupled to the base. The drive shaft of the motor extends through an orifice in the end closing plate of the spool. A clutch device is attached to the outer end of the drive shaft and has a first position with respect to the spool in which the drive shaft is coupled to the spool for rotation thereof and a second position in which rotation of the spool is resisted.

Both a drive device and a brake device is associated with the clutch. When the spool is shifted in one direction by means of a solenoid, the drive means on the clutch engages a corresponding drive means on the spool to rotate it. When the solenoid is released, a spring separates the spool and the clutch and causes the clutch to engage a brake on the spool, thus tending to resist any further rotation of the spool.

In addition, a switch is formed on the eyelet through which the tow rope moves such that when the tow rope is completely reeled in, the switch in the eyelet is operated to shut off the motor.

While the invention has been described in connection with preferred embodiments, it is not intended to limit the scope of the invention to the particular form set forth, but, on the contrary, it is intended to cover such alternatives, modifications, and equivalents as may be included within the spirit and scope of the invention as defined by the appended claims.

I claim:

1. A cord winding device comprising:

a base;

a motor attached to the base, said motor having a drive shaft with an outer end extending in a direction away from said base;

a hollow spool open at one end and having a plate closing the other end, said spool surrounding said motor and being rotatably mounted on said base, said drive shaft extending through an orifice in said end closing plate of said spool;

clutch means for selectively engaging said motor to said spool, said clutch means being attached to the outer end of said drive shaft and having a first position with respect to said spool in which said drive shaft is coupled to the spool for rotation thereof in one direction by said motor and a second position with respect to said spool in which rotation of said spool in the opposite direction is resisted;

first protrusions on one side of said end closing plate facing said clutch means;

second protrusions on one side of said clutch means facing said end closing plate;

a first friction disc on the other side of said clutch means;

a second plate attached to said other end of said spool, said second plate having a second friction disc on the side facing said first friction disc; and means for moving said spool axially with respect to said motor from a first position in which said first protrusions engage said second protrusions for rotating said spool by said motor in one direction and to a second position in which said first and second protrusions are disengaged and said first and second friction discs are engaged so as to resist rotation of said spool with respect to said motor in the opposite direction.

2. A device as in claim 1 further comprising:

spaced bearings mounted on said base; and said spool having an inner diameter such that said spool rides on said bearings in both said first and second axial positions of said spool.

3. A device as in claim 2 further comprising:

a solenoid body coupled to said base; and a solenoid plunger in communication with said other end closing plate of said spool such that when said solenoid is energized, said plunger moves the spool axially from its second position to its first position.

4. A rope winding device as in claim 3 further including a spring means between said clutch means and said end closing plate to return said spool to said second position when said solenoid is de-energized.

5. A water ski system including a water ski rope winding device mounted on a boat having a dashboard, the combination comprising:

a rotatable hollow spool for receiving a water ski rope on the outside thereof;

drive motor inside said hollow spool having a drive shaft for rotating said spool to wind the said rope on said spool;

power means inside said hollow spool and arranged between said drive motor and said spool for axially moving said spool relative to said motor to selectively engage and disengage said spool with said drive shaft thereby selectively rotating said spool;

a base fixedly attached to the boat;

said drive motor being rigidly attached to said base and driven by a power source;

a first clutch plate rigidly attached to the inside of said spool and having first protrusions thereon; and a second clutch plate attached to said drive shaft having second protrusions thereon for selectively engaging said first protrusions on said first clutch plate when said spool is moved axially in one direction so as to rotate said spool to wind in said rope and for disengaging said first protrusions on said first clutch plate when said spool is moved in the opposite direction to allow said spool to rotate as rope is pulled from said spool.

6. A rope winding device as in claim 5 wherein said power means comprises:

at least one solenoid coupled to said base; and a solenoid plunger in said at least one solenoid in communication with said spool such that when said at least one solenoid is operated, said at least one plunger moves the spool and the first clutch plate with the first protrusions axially into engagement with the second protrusions of the second clutch plate for rotating said spool.

7. A rope winding device as in claim 6 further including means for biasing said spool in a direction for disengaging said first clutch plate from said second clutch plate when said at least one solenoid plunger is released so as to allow rotation of said spool to release said rope.

8. A rope winding device as in claim 7 wherein:

said first clutch plate is attached to the inside of said spool in a plane perpendicular to the spool axis with said first protrusions on one side thereof; and said second clutch plate includes the second set of projections on one side of said second clutch plate facing said first clutch plate for engaging said first set of projections on said first clutch plate only when said at least one solenoid is energized.

9. A rope winding device as in claim 8 further including:

a friction device on the base adjacent and facing said spool; and a flange on said spool adjacent and facing said friction device such that when said at least one solenoid plunger is not activated, said spool biasing means forces said spool flange against said friction device to prevent free rotation of said spool and when said at least one solenoid plunger is actuated, said flange is forced away from said friction device to allow said spool to be rotated by said motor.

10. A rope winding device as in claim 9 further comprising at least three evenly spaced bearings on said base extending inside said hollow spool for supporting said spool.

11. A combination as in claim 5 further comprising:

an eyelet attached to the boat;

a lead rope attached to the ski rope, the lead rope passing through eyelet; and a first stop member in a first fixed position on said ski rope, said first stop member being too large to pass through said eyelet thereby providing support for said skier when said skier is being pulled by said boat.

12. A rope winding device as in claim 11 further including:

a second stop member in a second fixed position on said lead rope near the skier; and a normally closed electrical switch on said eyelet in electrical series with said motor power circuit such that when said rope is being pulled in with said second stop member attached, said second stop member, when striking said eyelet, actuates said switch to open the power circuit to said motor thus stopping said motor and the winding of said ski rope.

13. A rope winding device as in claim 12 further including:

a dashboard switch in electrical series with said motor and said eyelet switch that when said eyelet switch is closed and said dashboard switch is closed, said motor will rotate said spool to reel in said rope;

when said eyelet switch is open and said dashboard switch is closed, said motor stops because said rope is reeled in to the maximum;

when said eyelet switch is open and said dashboard switch is open, said rope is in its normal wound-in state; and when said eyelet switch is closed and said dashboard switch is open, said rope is being pulled out manually.

14. A rope winding device as in claim 13 wherein said second stop member comprises:

a spherical body portion having a first orifice for receiving said lead rope, said body portion having a diameter sufficient to prevent said body from passing through said eyelet and sufficient to actuate said eyelet switch when pulled into said eyelet as said rope is reeled in, said spherical shape forcing said second stop member into said eyelet switch regardless of the direction in which said second stop member is pulled into said eyelet; and a second orifice in said spherical body portion for receiving a rope that holds a skier.

* * * * *